United States Patent [19]

Sagel et al.

[11] 3,932,316

[45] Jan. 13, 1976

[54] FREE FLOWING DETERGENT COMPOSITIONS CONTAINING BENZOATE SALTS

[75] Inventors: John A. Sagel, Mount Healthy, Ohio; Clarence Edward Weber, Cold Spring, Ky.

[73] Assignee: The Procter & Gamble Company, Cincinnati, Ohio

[22] Filed: Nov. 13, 1974

[21] Appl. No.: 523,391

[52] U.S. Cl. ..... 252/532; 252/89; 252/131; 252/135; 252/140; 252/383; 252/384; 252/551

[51] Int. Cl.[2]... C11D 3/08; C11D 3/10; C11D 3/20; C11D 11/02

[58] Field of Search ..... 252/383, 384, 89, 135, 252/132, 133, 131, 179, 532, 551, 140

[56] References Cited

UNITED STATES PATENTS

| | | | |
|---|---|---|---|
| 2,055,581 | 9/1936 | Leben | 252/110 X |
| 3,198,740 | 8/1965 | Dunlop | 252/93 X |
| 3,284,362 | 11/1966 | Zussman | 252/107 |
| 3,346,504 | 10/1967 | Herrmann | 252/526 |
| 3,346,873 | 10/1967 | Herrmann | 252/526 |
| 3,424,689 | 1/1969 | Kakegawa | 252/526 |
| 3,446,743 | 5/1969 | Marquis | 252/383 |
| 3,639,248 | 2/1972 | Moyer | 252/384 |
| 3,843,563 | 10/1974 | Davies | 252/547 |

FOREIGN PATENTS OR APPLICATIONS

| | | | |
|---|---|---|---|
| 2,342,461 | 3/1974 | Germany | 252/140 |

*Primary Examiner*—Dennis E. Talbert, Jr.
*Assistant Examiner*—Dennis L. Albrecht
*Attorney, Agent, or Firm*—Forrest L. Collins; Charles R. Wilson; Richard C. Witte

[57] ABSTRACT

A non-phosphate built granular detergent composition is prepared which exhibits a free-flowing character resulting from the addition to the composition of benzoate salts as an anti-caking aid.

9 Claims, 3 Drawing Figures

FREE FLOWING DETERGENT COMPOSITIONS CONTAINING BENZOATE SALTS

BACKGROUND OF THE INVENTION

The instant invention relates to granular detergent compositions which are resistant to granule lumping, said product exhibiting free-flowing granules upon pouring.

Recent attempts have been made to eliminate phosphate builders from detergent compositions because of the ability of these materials to act as a nutrient in promoting the growth of algae. As a consequence of the possible ecological effects of the continued use of phosphate builders in substantial quantities, attempts have been made to materially reduce or eliminate the need for phosphate salts in commercial detergent compositions.

A significant drawback in the elimination of phosphate builders from detergent products is that non-phosphate built products have poorer lumping and caking properties. More particularly, non-phosphate built products lack the capacity under conditions of high humidity and temperature to maintain their discrete granular form. A phosphate built product such as one employing sodium tripolyphosphate has a tendency to act as a moisture sink under conditions of high humidity, thereby lowering the caking effects upon the detergent granules Non-phosphate built products, however, such as those employing water-soluble salts of carbonates, bicarbonates, silicates, citrates and sesquicarbonates, while having a certain tendency to act as a moisture sink, do not perform as well in that capacity as phosphates. The use of a non-phosphate builder under conditions of high humidity results in a sticky, non-free-flowing product in a short period of time after the detergent package has been opened. Under very high humidity conditions a non-phosphate built product may cake to such an extent that a substantial amount of the detergent product cannot be removed from the package.

In order to compensate for the loss of the effective moisture sink provided by the phosphate builders, it has been suggested to use a more protective packaging material for the detergent composition. The use of a more humidity resistant packaging suffers from the defects of increased cost and the protection is substantially lessened upon the consumer's opening of the package. Prior art methods suggested to reduce the caking tendency of non-phosphate products include the use of toluene sulfonate or sodium sulfosuccinate as anti-caking agents. Sodium sulfosuccinate is a relatively expensive material to use while toluene sulfonate in a non-phosphate product may actually aggravate caking.

As an alternative to the inclusion of a phosphate builder moisture sink, special packaging or the use of other anti-caking agents, the applicants have found that the salts of benzoic acid are employed as effective anti-caking agents.

Accordingly, it is an object of the present invention to provide a non-phosphate detergent granule which is resistant to humidity caking.

It is a further object of the present invention to provide a non-phosphate detergent granule which requires less special packaging to ensure a free-flowing product.

It has been surprisingly discovered that the addition of salts of benzoic acid when thoroughly mixed in the detergent composition will give a granular detergent with exceptional pourability, storage stability, and acceptable caking properties.

The above-described desirable effects are most noticeably observed in a non-phosphate detergent granule which does not contain toluene sulfonate. In products in which toluene sulfonate must be used for other purposes, such as to reduce acid mix viscosity, the salts of benzoic acid taught in this patent minimize the tendency of the toluene sulfonate to cause a sticky, non-free-flowing product. Detergent compositions utilizing benzoic acid as a viscosity aid to reduce acid mix viscosity are described in the concurrently filed and commonly assigned U.S. Pat. applications of J. A. Sagel and C. E. Weber having Ser. No. 523,392 and a filing date of Nov. 13, 1974 and Ser. No. 523,390 and a filing date of Nov. 13, 1974 herein incorporated by reference.

SUMMARY OF THE INVENTION

One aspect of the applicants' invention is a freeflowing non-phosphate, non-calcium carbonate containing granular detergent composition comprising:

a. from 5 to 90% by weight of a water-soluble detergency builder;
b. from 5 to 50% by weight of an organic water-soluble synthetic detergent selected from the group consisting of anionic, nonionic, zwitterionic, and ampholytic detergents and mixtures thereof; and
c. from about 0.10 to about 13% by weight of a salt of benzoic acid.

Another aspect of the applicants' invention includes elements (a) through (c) listed above and additionally comprises a crystallization seed in from 1 to 40% by weight of the total composition. The crystallization seed mentioned above functions as a growth site for hardness ions which have been precipitated by a precipitating builder salt anion.

When percentages or ratios are given throughout the application, the measurement is by weight unless expressly otherwise stated. Alkyl includes branch-chained as well as straight-chained material when used throughout the application.

DETAILED DESCRIPTION OF THE INVENTION

Figure 1:
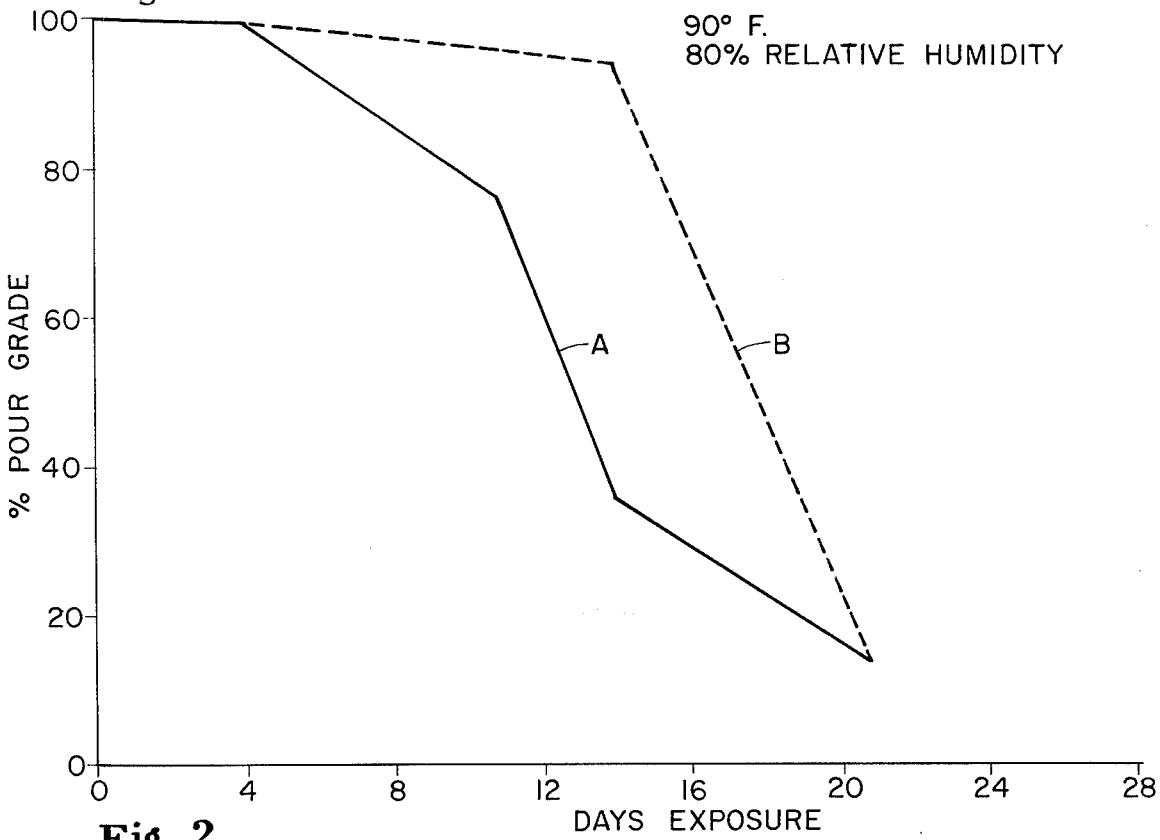

The instant invention comprises three components. The first of these components is a water-soluble, non-phosphate detergency builder. The second component is an organic watersoluble synthetic detergent selected from the group consisting of anionic, nonionic, zwitterionic, and ampholytic detergents and mixtures thereof. The third component of this composition is a salt of benzoic acid.

The present invention is best appreciated in a composition in which toluene sulfonate is absent. However, in cases where toluene sulfonate is present, the benefits of the invention, while somewhat offset, will still give a relatively free-flowing spray-dried granular detergent composition.

ANTI-CAKING AID

The anti-caking aid used in producing the free-flowing, relatively non-caking detergent granules of this invention are the salts of benzoic acid. The preferred benzoate salts used as anti-caking aids are preferably water-soluble, such as the ammonium, sodium, and potassium salts; however, water-insoluble salts are also employed such as the calcium or magnesium salts. The anti-caking aids are added at any point in the processing of the detergent composition provided that they are added at such a point that they become thoroughly mixed with the other components before granule formation. While spray-drying is the preferred method of preparing the granules, methods such as agglomeration, fluidized beds, drum drying, or ribbon drying as described in U.S. Pat. No. 3,202,613 herein incorporated by reference, are useful in the present invention.

If the salts are of benzoic acid which are somewhat insoluble in organic solution, the most convenient point of addition will be in the crutcher mix where water and other salts are present.

Benzoic acid is used in the present invention to achieve in situ formation of its salts. Thus, benzoic acid is added to the crutcher mix and neutralized along with the other materials present, or the benzoic acid is added as a viscosity to the detergent precursor as is described in the two concurrently filed commonly assigned applications previously incorporated by reference.

The composition in the crutcher mix contains a variety of materials such as neutralized or partially-neutralized detergents, inorganic and organic builders, water, additional inorganic salts such as sodium sulfate, and other optional ingredients such as a crystallization seed described later in this patent and toluene sulfonate. This complex crutcher mix exhibiting water-soluble and insoluble inorganic matter and organic materials of varying ionic character will give granules with a substantial proportion of organic material on the outer surface of the granule. It has been found by the patentee that granules with a substantial proportion of organic material on the outer surfaces of the granule will tend to be a stickier, less free-flowing product when exposed to conditions of high humidity.

The patentees have discovered that by the addition of anti-caking aid of this invention that the amount of organic material on the outer surface of the detergent granule is kept to a minimum. Thus under conditions of high humidity, the product tends to be less sticky and more free-flowing. Without being bound to any theory, it is the applicants' belief that the presence of the benzoate salts in the crutcher mix tends to cause the detergent composition to form droplets in which the organic phase has a reduced solubility in the surrounding aqueous phase, the result being a granule which contains a substantial portion of inorganic matter in the outer surface of the granule.

The amount of the anti-caking aid added to the crutcher plus the amount added as a viscosity aid make up the total amount present in the final granular product.

The amount of anti-caking aid used in the present detergent composition will depend upon the factor determinative of the miscibility of the organic and inorganic phases in the crutcher mix. Factors determining miscibility of the organic and inorganic phases of the crutcher include the relative concentrations of the water in the crutcher, the amounts and types of inorganic salts present, the concentration and nature of the organic material present, and the temperature of the crutcher mix. Other factors useful in determining the amount of anti-caking aid to be used will become apparent upon experimentation. The amount of anti-caking aid should be between about 0.1 and about 13%, preferably about 0.5 to about 10%, and more preferably about 2 to 8% by weight of the finished product. Larger amounts of anti-caking aid may be utilized; however, amounts greater than 13% do not substantially contribute to the anti-caking benefits of the present invention.

DETERGENT COMPONENT

Preferably the detergent component of the present invention is a water-soluble salt of: an ethoxylated sulfated alcohol with an average degree of ethoxylation of about 1 to 4 and an alkyl chain length of about 14 to 16; tallow ethoxy sulfate; tallow alcohol sulfates; an alkyl benzene sulfonate with an average alkyl chain length between 11 and 12, preferably 11.2 carbon atoms; a $C_6$–$C_{20}$ $\alpha$-sulfocarboxylic acid or ester thereof having 1 to 14 carbon atoms in the alcohol radical; a $C_8$–$C_{24}$ paraffin sulfonate; a $C_{10}$–$C_{24}$ $\alpha$-olefin sulfonate or mixtures thereof; or other anionic sulfur-containing surfactant. Such preferred detergents are discussed below.

An especially preferred alkyl ether sulfate detergent component of the present invention is a mixture of alkyl ether sulfates, said mixture having an average (arithmetic mean) carbon chain length within the range of about 12 to 16 carbon atoms, preferably from about 14 to 15 carbon atoms, and an average (arithmetic mean) degree of ethoxylation of from about 1 to 4 moles of ethylene oxide, preferably from about 2 to 3 moles of ethylene oxide.

Specifically, such preferred mixtures comprise from about 0 to 10% by weight of mixture of $C_{12\text{-}13}$ compounds, from about 50 to 100% by weight of mixture of $C_{14\text{-}15}$ compounds, and from about 0 to 45% by weight of mixture of $C_{16\text{-}17}$ compounds, and from about 0 to 10% by weight of a mixture of $C_{18\text{-}19}$ compounds. Further, such preferred alkyl ether sulfate mixtures comprise from about 0 to 30% by weight of mixture of compounds having a degree of ethoxylation of 0, from about 45 to 95% by weight of mixture of compounds having a degree of ethoxylation from 1 to 4, from about 5 to 25% by weight of mixture of compounds having a degree of ethoxylation from 5 to 8, and from about 0 to 15% by weight of mixture of compounds having a degree of ethoxylation greater than 8. The sulfated condensation products of ethoxylated alcohols of 8 to 24 alkyl carbons and with from 1 to 30, preferably 1 to 4 moles of ethylene oxide may be used in place of the preferred alkyl ether sulfates discussed above.

Another class of detergents which may be used in the present invention includes the water-soluble salts, particularly the alkali metal, ammonium, and alkylolammonium salts of organic sulfuric reaction products having in their molecular structure an alkyl group containing from about 8 to about 22 carbon atoms and a sulfuric acid ester group. Examples of this group of synthetic detergents are the sodium and potassium alkyl sulfates, especially those obtained by sulfating the higher alcohols ($C_8$–$C_{18}$ carbon atoms) produced by reducing the glycerides of tallow or coconut oil.

Preferred water-soluble organic detergent compounds herein include linear alkyl benzene sulfonates containing from about 9 to 15 carbon atoms in the alkyl group. Examples of the above are sodium and potassium alkyl benzene sulfonates in which the alkyl group contains from about 11 to about 12 carbon atoms, in straight chain or branched chain configuration, e.g., those of the type described in U.S. Pat. Nos. 2,220,099 and 2,477,383. Especially valuable are straight chain alkyl benzene sulfonates in which the average of the alkyl groups is about 11.2 carbon atoms, abbreviated as $C_{11.2}$LAS.

Another useful detergent compound herein includes the water-soluble salts of esters of α-sulfonated fatty acids containing from about 6 to 20 carbon atoms in the fatty acid group and their esters from about 1 to 14 carbon atoms in the alcohol radical.

Preferred "olefin sulfonate" detergent mixtures utilizable yerein comprise olefin sulfonates containing from about 10 to about 24 carbon atoms. Such materials can be produced by sulfonation of α-olefins by means of uncomplexed sulfur trioxide followed by neutralization under conditions such that any sultones present are hydrolyzed to the corresponding hydroxyalkane sulfonates. The α-olefin starting materials preferably have from 14 to 16 carbon atoms. Said preferred α-olefin sulfonates are described in U.S. Pat. 3,332,880, incorporated herein by reference.

The paraffin sulfonates embraced in the present invention are essentially linear and contain from 8 to 24 carbon atoms, preferably 12 to 20 and more preferably 14 to 18 carbon atoms in the alkyl radical.

Other anionic detergent compounds herein include the sodium alkyl glyceryl ether sulfates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

Water-soluble salts of the higher fatty acids, i.e. "soaps", are useful as the detergent component of the composition herein. This class of detergents includes ordinary alkali metal soaps such as the sodium, potassium, ammonium and alkylolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Water-soluble nonionic synthetic detergents are also useful as the detergent component of the instant composition. Such nonionic detergent materials can be broadly defined as compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

For example, a well-known class of nonionic synthetic detergents is made available on the market under the trade name "Pluronic" sold by Wyandotte Chemicals. These compounds are formed by condensing ethylene oxide with a hydrophobic based formed by the condensation of propylene oxide with propylene glycol. Other suitable nonionic synthetic detergents include the polyethylene oxide condensates of alkyl phenols, e.g., the condensation products of alkyl phenols having an alkyl group containing from about 6 to 12 carbon atoms in either a straight chain or branched chain configuration, with ethylene oxide, the said ethylene oxide being present in amounts equal to 5 to 25 moles of ethylene oxide per mole of alkyl phenol.

The water-soluble condensation products of aliphatic alcohols having from 8 to 22 carbon atoms, in either straight chain or branched configuration, with ethylene oxide, e.g., a coconut alcohol-ethylene oxide condensate having from 5 to 30 moles of ethylene oxide per mole of coconut alcohol, the coconut alcohol fraction having from 10 to 14 carbon atoms, are also useful nonionic detergents herein.

Semi-polar nonionic detergents include water-soluble amine oxides containing one alkyl moiety of from about 10 to 28 carbon atoms and 2 moieties selected from the group consisting of alkyl groups and hydroxyalkyl groups containing from 1 to about 3 carbon atoms; water-soluble phosphine oxide detergents containing one alkyl moiety of about 10 to 28 carbon atoms and 2 moieties selected from the group consisting of alkyl groups and hydroxyalkyl groups containing from about 1 to 3 carbon atoms; and water-soluble sulfoxide detergents containing one alkyl moiety of from about 10 to 28 carbon atoms and a moiety selected from the group consisting of alkyl and hydroxyalkyl moieties of from 1 to 3 carbon atoms.

Ampholytic detergents include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic detergents include derivatives of aliphatic quaternary ammonium, phosphonium and sulfonium compounds in which the aliphatic moieties can be straight chain or branched, and wherein one of the aliphatic substituents contains from about 8 to 18 carbon atoms and one contains an anionic water-solubilizing group.

Other useful detergents include water-soluble salts of 2-acyloxy-alkane-1-sulfonic acids containing from about 2 to 9 carbon atoms in the acyl group and from about 9 to about 23 carbon atoms in the alkane moiety; β-alkyloxy alkane sulfonates containing from about 1 to 3 carbon atoms in the alkyl group and from about 8 to 20 carbon atoms in the alkane moiety; alkyl dimethyl amine oxides wherein the alkyl group contains from about 11 to 16 carbon atoms; alkyldimethyl-ammonio-propane-sulfonates and alkyl-dimethyl-ammonio-hydroxypropane-sulfonates wherein the alkyl group in both types contains from about 14 to 18 carbon atoms; soaps as hereinabove defined; the condensation product of tallow fatty alcohol with about 11 moles of ethylene oxide; the condensation product of a $C_{13}$ (avg.) secondary alcohol with 9 moles of ethylene oxide; and alkyl glyceral ether sulfates with from 10 to 18 carbon atoms in the alkyl radical.

A typical listing of the classes and species of detergent compounds useful herein appear in U.S. Pat. No. 3,664,961, incorporated herein by reference. The following list of detergent compounds and mixtures which can be used in the instant compositions is representative of such materials, but is not intended to be limiting.

The detergent is present at levels of about 5 to 50% and preferably about 10 to 30% by weight of the finished product.

It is to be recognized that any of the foregoing detergents can be used separately herein or as mixtures.

BUILDER COMPONENT

Examples of suitable water-soluble, inorganic detergency builder salts are alkali metal carbonates, borates, bicarbonates, silicates and sulfates. Specific examples of such salts are sodium and potassium tetraborates, perborates, bicarbonates and carbonates. If desired, a seeded carbonate system such as the one discussed under optional ingredients may be employed. Sodium sulfate, although not classed as a builder salt, is included in this category.

A preferred builder system comprises using zeolitic materials as described in the following copending applications incorporated by reference: Ser. No. 450,266, Corkill, Madison and Burns, filed Mar. 11, 1974; Ser. No. 379,881, Gedge and Madison, filed July 16, 1973; Ser. No. 379,882, Madison and Corkill, filed July 16, 1973; and Ser. No. 379,883, Corkill and Madison, filed July 16, 1973.

Examples of suitable organic detergency builder salts are: (1) water-soluble aminopolycarboxylates, e.g. sodium and potassium ethylenediaminetetraacetates, nitrilotriacetates and N-(2-hydroxyethyl)-nitrilodiacetates; (2) water-soluble salts of phytic acid, e.g. , sodium and potassium phytates — see U.S. Pat. No. 2,739,942; (3) water-soluble polyphosphonates, including specifically, sodium, potassium and lithium salts of ethane-1-hydroxy-1,1-diphosphonic acid, sodium, potassium and lithium salts of methylene diphosphonic acid, sodium, potassium and lithium salts of ethylene diphosphonic acid, and sodium, potassium and lithium salts of ethane-1,1,2-triphosphonic acid. Other examples include the alkali metal salts of ethane-2-carboxy-1,1-diphosphonic acid, hydroxymethanediphosphonic acid, carbonyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetraphosphonic acid; and (4) water-soluble salts of polycarboxylate polymers and copolymers as described in U.S. Pat. No. 3,308,067.

A useful detergent builder which may be employed in the present invention comprises a water-soluble salt of a polymeric aliphatic polycarboxylic acid having the following structural relationships as to the position of the carboxylate groups and possessing the following prescribed physical characteristics: (a) a minimum molecular weight of about 350 calculated as to the acid form; (b) an equivalent weight of about 50 to about 80 calculated as to acid form; (c) at least 45 mole percent of the monomeric species having at least two carboxyl radicals separated from each other by not more than two carbon atoms; (d) the site of attachment of the polymer chain of any carboxyl-containing radical being separated by not more than three carbon atoms along the polymer chain from the site of attachment of the next carboxyl-containing radical. Specific examples of the above-described builders include polymers of itaconic acid, aconitic acid, maleic acid, mesaconic acid, fumaric acid, methylene malonic acid and citraconic acid and copolymers with themselves.

In addition, other builders which can be used satisfactorily include water-soluble salts of mellitic acid, citric acid, pyromellitic acid, benzene pentacarboxylic acid, oxydiacetic acid, carboxymethyloxysuccinic acid, and oxydisuccinic acid.

The builder-containing detergent compositions of this invention contain a water-soluble detergent and builder in a weight ratio of 10:1 to 1:10. The amount of builder in the detergent composition is from about 5 to 90%, preferably about 10 to 60%, and most preferably about 20 to 50% by weight in a weight ratio of detergent to builder of from 2:3 to 1:5.

OPTIONAL INGREDIENTS

Other ingredients can also be added to the detergent composition of this invention. Soil-suspending agents such as water-soluble salts of carboxymethylcellulose and carboxyhydroxymethylcellulose are common components of detergent compositions of this type. Dyes, pigments, optical brighteners, and perfumes can be added in varying amounts if desired. Other materials such as fluorescers, antiseptics, germicides, enzymes, and minor amounts of other anti-caking aids may also be added.

Crystallization seeds which may be incorporated into the present invention at levels of 1 to 40%, preferably 5 to 25% by weight are as follows: calcium carbonate, calcium and magnesium oxalate, barium sulfate, calcium, magnesium and aluminum silicates, calcium and magnesium oxides, calcium and magnesium salts of fatty acids having from 12 to 22 carbon atoms, calcium and magnesium hydroxide, calcium fluoride, barium carbonate. The use of crystallization seeds is described in Canadian Pat. No. 511,607, British Pat. No. 607,274, and Belgian Pat. No. 798,856 all of which are incorporated by reference. Processes for preparing calcium carbonate, a preferred crystallization seed, are described in British Pat. No. 962,812, incorporated by reference. The crystallization seed, if utilized in the present invention, should have a particle size of less than 1 micron. Calcium carbonate crystallization seeds meeting the above specifications are available from Wyandotte Chemical Company under the trade names Purecal O and Purecal U. Preferentially, crystallization seeds will be in the range of less than 1 micron with a surface area greater than 50 $m^2/gm$.

Another manner of incorporating crystallization seeds and a precipitating builder is to use a double salt such as gaylussite or pirssonite or their anhydrous form. The above salts have the formula $CaCO_3 \cdot Na_2CO_3 \cdot xH_2O$ where $x = 5$, 2, or 0, respectively.

The crystallization seeds mentioned above are used in combination with a builder which precipitates rather than sequesters hardness ions. Examples of precipitating builder salts are sodium carbonate, sodium oxylate, and other water soluble salts which will precipitate calcium and magnesium ions to form a salt at least as insoluble as the crystallization seed employed.

COMPOSITION PREPARATION AND UTILIZATION

The compositions of the present invention are preferably prepared by spray-drying an aqueous slurry of the various components which have been admixed in the crutcher. The total composition in the crutcher is about 60 to 75% solids, preferably about 68%. The slurry in the crutcher is maintained between about 130°F to 200°F, preferably at about 180°F. The spray-drying is accomplished by pumping the slurry to a conventional spray-drying tower. Preferred methods and apparatus for spray-drying are described in U.S. Pat. Nos. 3,629,951 and 3,629,955, herein incorporated by reference.

Alternatively, the granules may be prepared by agglomeration as described in U.S. Pat. No. 2,895,916.

Further refinements in the art such as using the fluidzed bed may be employed in the present invention.

The following examples are illustrative of the present invention:

EXAMPLE I 1.7 parts of benzoic acid are dissolved in 12 parts of an ethoxylated alcohol having an alkyl chain length average varying between 12 and 16 and the average degree of ethoxylation of said mixture varying between 1 and 4 moles of ethylene oxide, said mixture comprising:

a. from about 0 to 10% by weight of said ethoxylated alcohol mixture of compounds containing 12 or 13 carbon atoms in the alkyl radical;
b. from about 50 to 100% by weight of said ethoxylated alcohol mixture of compounds containing 14 or 15 carbon atoms in the alkyl radical;
c. from about 0 to 45% by weight of said ethoxylated alcohol mixture of compounds containing 16 or 17 carbon atoms in the alkyl radical;
d. from about 0 to 10% by weight of said ethoxylated alcohol mixture of compounds containing 18 or 19 carbon atoms in the alkyl radical;
e. from about 3 to 30% by weight of said ethoxylated alcohol mixture of compounds having a degree of ethoxylation of zero;
f. from about 45 to 95% by weight of said ethoxylated alcohol mixture of compounds having a degree of ethoxylation of from 1 to 4;
g. from about 5 to 25% by weight of said ethoxylated alcohol mixture of compounds having a degree of ethoxylation of from 5 to 8;
h. from about 0 to 15% by weight of said ethoxylated alcohol mixture of compounds having a degree of ethoxylation greater than 8.

The combined mixture is then sulfated with 30% oleum using conventional sulfation practices. The resultant acid mix is then neutralized with caustic forming a paste of a sodium alkyl ether sulfate and the sodium salt of benzoic acid together with sodium sulfate and the water of neutralization.

25 parts of sodium carbonate are added to the paste and the composition is thoroughly mixed. The composition is then spray-dried by conventional methods to give a uniform free-flowing non-sticky detergent granule.

EXAMPLE II

The same composition is prepared as in Example I; however 22 grams of (Purecal O) calcium carbonate are added to the crutcher slurry and thoroughly mixed. The slurry is then spray-dried to obtain a free-flowing detergent granule. The detergent of this example is relatively calcium hardness insensitive and thereby maintains a higher effective concentration in an underbuilt system. The detergent used herein does not substantially inhibit the seeding function by adsorbing on the growth sites of the seeds.

EXAMPLE III

A detergent granule is prepared by agglomeration using the compounds described in Example 1 wherein the synthetic detergent makes up 70% of the spray-dried composition, the sodium carbonate builder 5% and the sodium benzoate 13%. Moisture, sodium sulfate, and other minor ingredients make up the remainder.

EXAMPLE IV

A free-flowing spray-dried detergent granule is prepared by sulfonating an alkyl benzene having an average of 11 to 12 carbon atoms in the essentially linear alkyl radical. The resultant material is neutralized with caustic and the mixture is combined with sodium carbonate and potassium benzoate in the crutcher such that the alkyl benzene sulfonate makes up 5% by weight of the spray-dried final product, the potassium benzoate .5% and the $Na_2CO_3$ 90%. Moisture, $Na_2SO_4$ and other ingredients make up the remainder.

EXAMPLE V 7.0 parts of benzoic acid are dissolved in 13.0 parts of an ethoxylated alcohol having an alkyl chain length average varying between 16 and 19 and the average degree of ethoxylation of said mixture varying between 1 and 5 moles of ethylene oxide; said mixture comprising:

a. from about 0 to 2% by weight of said ethoxylated alcohol mixture of compounds containing 12 or 13 carbon atoms;
b. from about 0 to 33% by weight of said ethoxylated alcohol mixture of compounds containing 14 or 15 carbon atoms;
c. from about 25 to 55% by weight of said ethoxylated alcohol mixture of compounds containing 16 or 17 carbon atoms;
d. from about 30 to 70% by weight of said ethoxylated alcohol mixture of compounds containing 18 or 19 carbon atoms;
e. from about 1 to 30% by weight of said ethoxylated alcohol mixture of compounds having a degree of ethoxylation of zero;
f. from about 50 to 80% by weight of said ethoxylated alcohol mixture of compounds having a degree of ethoxylation of from 1 to 4;
g. from about 3 to 30% by weight of said ethoxylated alcohol mixture of compounds having a degree of ethoxylation of from 5 to 8; and
h. from about 0 to 10% by weight of said ethoxylated alcohol mixture of compounds having a degree of ethoxylation greater than 8.

The combined mixture is sulfated with 30% oleum using conventional sulfation practices. The resultant acid mix is then neutralized with caustic forming a paste of a sodium alkyl ether sulfate and the sodium salt of benzoic acid together with sodium sulfate and the water of neutralization.

40.0 parts of sodium carbonate are added to the paste and the composition is thoroughly mixed. The composition is then spray-dried by conventional methods to give uniform free-flowing non-sticky detergent granules.

EXAMPLE VI

A detergent granule is prepared using the ethoxylated alcohol described in Example V. The ethoxylated alcohol is sulfated by any method and neutralized with potassium hydroxide. The neutralized mixture is then combined with potassium benzoate and sodium carbonate in the crutcher such that the final spray-dried composition is 15% by weight potassium alkyl ether sulfate, 4% potassium benzoate, and 15% sodium carbonate. The mixture is then spray-dried to give a free-flowing granular product.

EXAMPLE VII

The following compositions are prepared and spray-dried:

| | A | B |
|---|---|---|
| Sodium alkyl ether sulfate* | 15.0% | 15.0% |
| Tallow alcohol sulfate | 2.0 | 2.0 |
| Purecal O $CaCO_3$ | 22.0 | 22.0 |
| $Na_2CO_3$ | 25.0 | 25.0 |
| $Na_2SO_4$ | 12.4 | 12.4 |
| Sodium silicate (2.4:1 $SiO_2$:$Na_2O$ | 14.1 | 14.1 |
| Sodium sulfosuccinate | 1.9 | 1.9 |
| Sodium benzoate | — | 2.0 |
| Sodium toluene sulfonate | 1.9 | — |
| Moisture | 3.5 | 3.5 |
| Minors | Balance | Balance |
| TOTAL | 100.0% | 100.0% |

*The distribution of chain lengths and ethoxylates of this material is within the ranges described in Example I.

Figure 2:
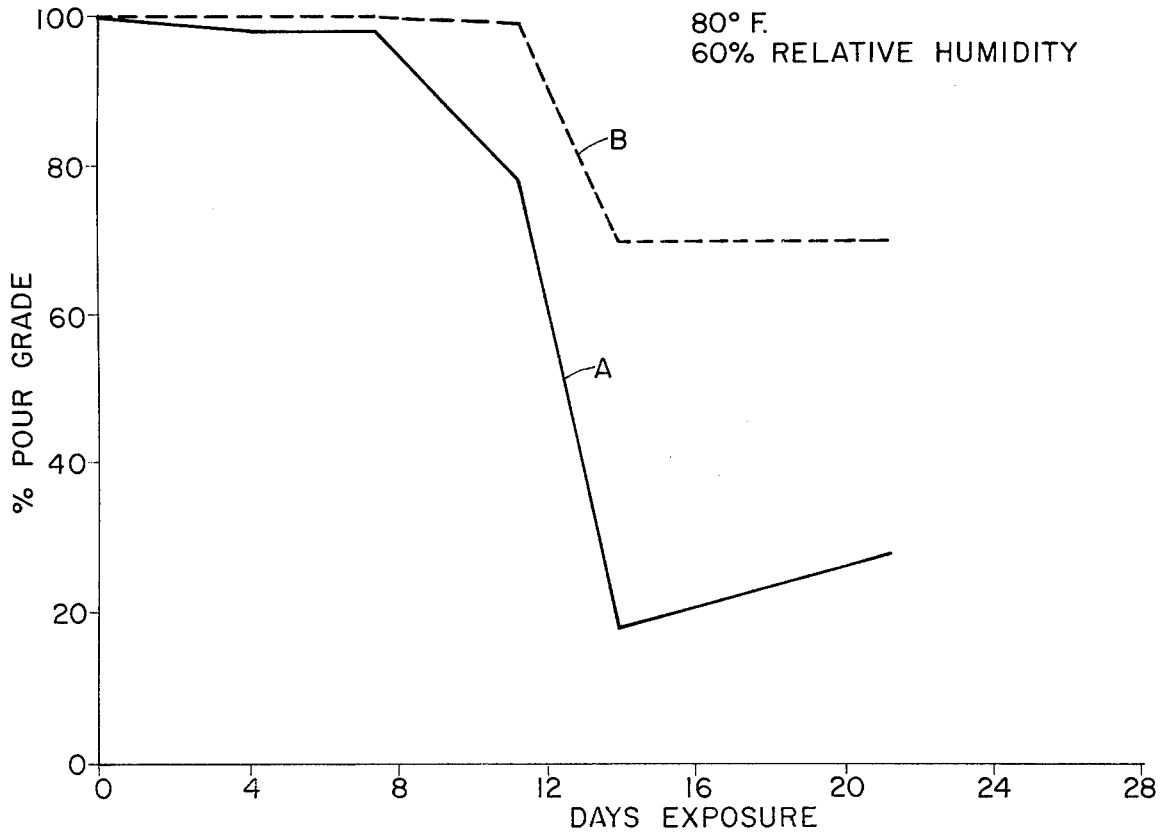
Figure 3:
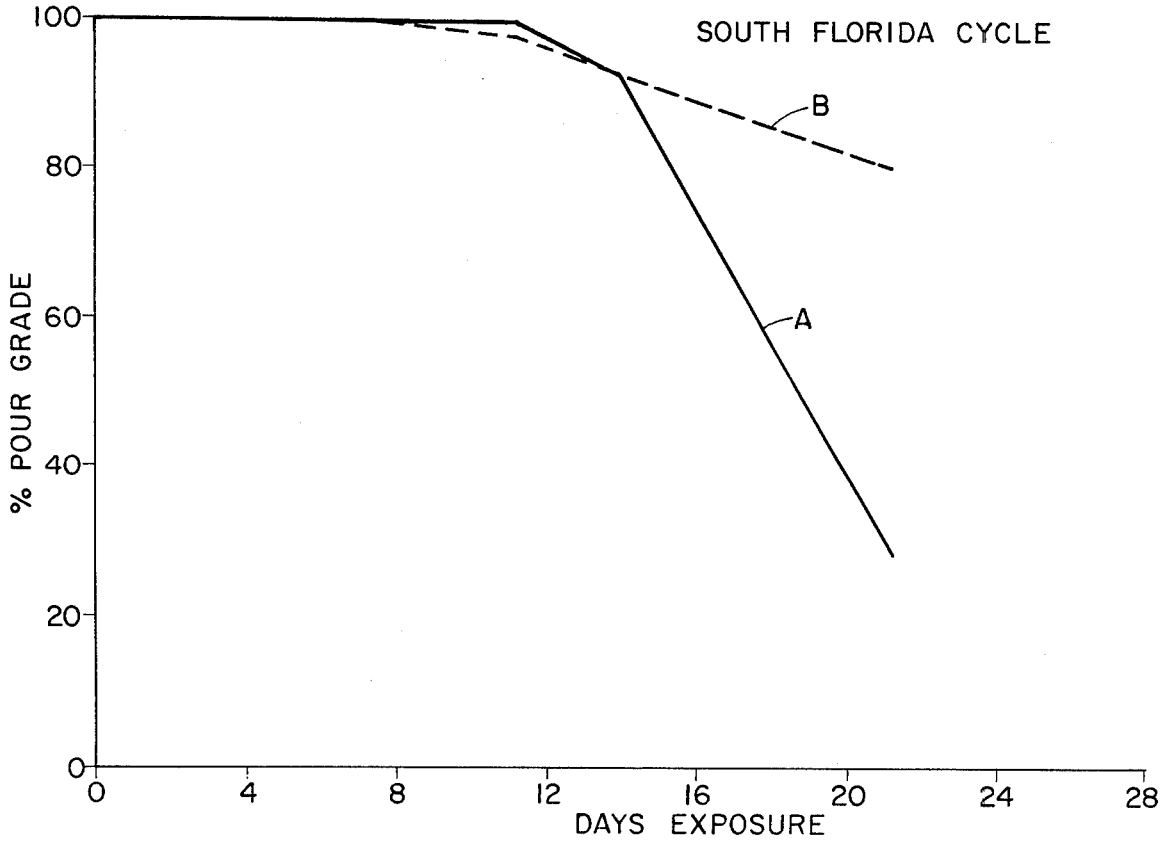

Compositions A and B of Example VII were measured for their percentage pour grade under varying conditions of temperature and humidity as is shown in FIGS. 1, 2 and 3. Composition B in accordance with the instant invention exhibits superior anti-caking tendencies over the prior art composition A.

The method of conducting a percentage pour grade test is as follows.

The spray-dried granular detergent compositions were packaged in conventional detergent cartons. The cartons were then torn open at the top to simulate handling of the product by a consumer. The void space in the cartons is approximately 6 inches by 2 inches by ⅞ inch. The flap formed by tearing the carton top is bent back such that it does not interfere with the access of the humid air to the product and presents an opening of approximately 2 inches by 2 inches. At various intervals during the test cartons containing compositions A and B were removed and the percentage pour grade was determined using a Granules Pouring Tester described below.

The Granules Pouring Tester is designed to hold a conventional detergent carton firmly while operating through the several cycles of the pour test. The first (pour) cycle of the pour test consists of placing an upright detergent carton in the Granules Pour Tester which has means to rotate the upright box through an angle of 150° from the vertical position with means to stop momentarily at the 150° position and return the box to its original position. The opened package while passing through and returning from the angle of 150° releases the product which passes through or is trapped by a wire screen of one-quarter inch mesh. The product flowing through said screen collects in a large graduated cylinder.

The free-flowing product consists of granules which have passed through the screen and those more lumpy granules which have been trapped by the screen. It is permissible during the test to tap the screen lightly to ensure that the product is above to flow around the lumpy granules trapped on the screen. The volume of graduated cylinder which has been tapped slightly to settle the detergent granules therein is then read and the volume is recorded. Any material retained on the screen should be ignored at this point. The graduated cylinder with the product remaining in it is replaced under the screen for the second stage of the pour test.

The second (shake) cycle of the pour test consists of shaking the detergent package as it is held in the Granules Pour Tester at 150° below the vertical or original position. The Granules Pour Tester is equipped with means to gently shake the package approximating the amount of force that a consumer would impart while attempting to remove the loosely packed product. The product passing through the screen is collected in the partially filled graduate and the volume is determined as it was at the end of the pour cycle again ignoring all lumpy material accumulated on the screen during the pour and shake cycles.

The third (crush) cycle of the pour test consists of breaking up the product lumps remaining on the screen from the pour and shake cycles and collecting those materials in the partially filled graduate. The total volume of product from the crush cycle is then determined.

The fourth (residue) cycle of the pour test consists of removing the residual product in the carton by hand, forcing it through the screen and into the cylinder to determine the total volume of the original packaged sample.

The percent pour grade is thus determined by the following formula:

$$\frac{A+B+C}{3} = \text{average grade}$$

$$\%\ \text{pour grade (corrected for volume)} = \frac{\text{average grade} \times 100}{D}$$

In the above formulas A is the amount of freeflowing non-lumpy material obtained in the pour cycle. B is the total amount of non-lumpy material available by pouring and moderate shaking. C is the total amount of material which can be removed from the package under the standard test conditions (i.e. B + lumpy material left on the ¼ inch screen). D is the total amount of material in the package (i.e., C + amount of product removed from the package by hand).

The percent pour grade (corrected for volume) is plotted in FIGS. 1–3 for compositions A and B against the days of exposure at the conditions stated on the face of each figure. A higher percent pour grade indicates that a product is less subject to humidity caking.

The South Florida Cycle (FIG. 3) approximates the conditions involving changes of temperature and changes in relative humidity which a detergent product would undergo in the hands of a consumer living in the southern half of Florida.

EXAMPLE VIII

Compositions A and B are prepared in accordance with Example VII wherein the sodium alkyl ether sulfate in the instant example has an average alkyl chain length of about 15 carbon atoms with at least 90% of the alkyl chains falling in the range of 14–16 and an average degree of ethoxylation of about 2.25. The mixture is then spray-dried to give a free-flowing granular product with acceptable caking properties.

EXAMPLE IX

The composition of Example I is prepared; however, in addition, 10 parts of the sodium salt of an $\alpha$-olefin sulfonate containing an alkyl distribution of 10–24 carbon atoms is added to the crutcher mix. The composition is then spray-dried to give a free-flowing non-lumping granular product.

EXAMPLE X

A composition is prepared containing the following materials:

| | |
|---|---|
| $C_{11.8}$ LAS | 20% |
| Aluminosilicate* | 25% |
| Sodium silicate ($Na_2O/SiO_2$ wt. ratio = 1:2.4) | 15% |
| $Na_2SO_4$ | 20% |
| Sodium acetate | 5% |
| Sodium benzoate | 2% |
| Water | 4% |
| Minors | Balance |

*The description of the aluminosilicates is found in U.S. Application Serial No. 379,882, previously incorporated by reference.

The composition is then spray-dried to give a freeflowing granular product.

Other compositions which are illustrative of the instant invention are set forth as follows in Table I.

TABLE I

| | | SURFACTANT (grams) | | BUILDER (grams) | | |
|---|---|---|---|---|---|---|
| Crispening Aid Added | Amount of Crispening Aid Added (grams) | $C_{12}$ LAS | $C_{16}$ α-olefin sulfonate | Sodium citrate | Sodium mellitate | Sodium silicate |
| Benzoic acid | 2 | 17 | | 30 | | 10 |
| Calcium benzoate | 3 | | 15 | | 10 | 15 |

The compositions given in the above Table are spray-dried to give free-flowing granules. The acid forms of the crispening aid will be present as salts in a granular product.

Compositions of the instant invention are employed by dissolving them in aqueous washing or laundering solutions to the extent of from about 0.01 to about 2% by weight. Preferably such compositions are utilized in water to the extent of from about 0.06 to about 0.18% by weight. This preferred concentration is approximated when about 0.5 to 1.5 cups of the instant detergent compositions are added to the 17–23 gallons of water held by commercially available washing machines. Washing solution pH provided by the instant compositions generally varies between 9.5 and 10.5. Soiled fabrics and other articles are added to the laundering liquor and cleansed in the usual manner.

What is claimed is:

1. A non-phosphate, non-calcium carbonate-containing spray dried granular detergent composition comprising:

a. from 5 to 90% by weight of a water-soluble detergency builder;

b. from 5 to 50% by weight of an organic watersoluble synthetic detergent selected from the group consisting of anionic, nonionic, zwitterionic, and ampholytic detergents and mixtures thereof; and c. from about 0.10 to about 13.0% by weight of a salt of benzoic acid.

2. The composition of claim 1 wherein component (c) is a water-soluble benzoic acid salt at from about 0.5 to about 10% by weight.

3. The composition of claim 2 wherein the detergency builder is selected from the group consisting of water-soluble salts of carbonates, bicarbonates, sesquicarbonates, citrates, and silicates.

4. The composition of claim 3 wherein the detergent is an alkyl ether sulfate wherein the alkyl group has from 8 to 24 carbon atoms and the degree of ethoxylation is from 1 to 30, said detergent being present at from 10 to 30% by weight; and the benzoate salt is present at from about 2 to 8% by weight.

5. The composition of claim 3 wherein component (c) is sodium benzoate.

6. A process for the preparation of a free-flowing, non-phosphate non-calcium carbonate containing granular detergent composition from a slurry comprising on a dry weight basis of from 5 to 90% by weight of a water-soluble detergency builder; from 5 to 50% by weight of an organic water-soluble synthetic detergent selected from the group consisting of anionic, nonionic, zwitterionic, and ampholytic detergents and mixtures thereof; the improvement thereon comprising including in said slurry from about 0.10 to 13% by weight on a dry basis of a benzoate salt and forming a granule from the slurry.

7. The process of claim 6 wherein the step of granule formation is accomplished by spray drying.

8. The process of claim 7 wherein the salt added is sodium benzoate.

9. The composition of claim 7 wherein the benzoic acid salt is calcium benzoate.

* * * * *